United States Patent [19]

Swisher

[11] 4,252,006

[45] Feb. 24, 1981

[54] UTILITY LOCK AND KEY

[76] Inventor: James A. Swisher, 464 Mill Hill Dr., Southport, Conn. 06490

[21] Appl. No.: 944,901

[22] Filed: Sep. 22, 1978

[51] Int. Cl.[3] ..... E05B 67/36

[52] U.S. Cl. ..... 70/34; 70/386; 70/422

[58] Field of Search ..... 70/32, 33, 34, 386, 70/422

[56] References Cited

U.S. PATENT DOCUMENTS

| | | | |
|---|---|---|---|
| 4,040,279 | 8/1977 | Signorelli | 70/34 |
| 4,058,992 | 11/1977 | Nielson | 70/34 |
| 4,063,434 | 12/1977 | Moberg | 70/34 |

*Primary Examiner*—Robert L. Wolfe
*Attorney, Agent, or Firm*—Cifelli & Frederick

[57] ABSTRACT

Utility type locks have a lock body including a head and a shank, a plunger axially slidably received in the lock body, and locking balls forced outwardly from the shank or retracted within the shank depending upon the position of the plunger. A coil spring biases the plunger away from the head of the lock, and is dimensioned such that it must be fully compressed for the plunger to permit the balls to retract. The plunger face defines a shallow annular groove surrounding a center post which resists picking tools. A preload bushing surrounds the plunger with a deformable lip engaging a shoulder of the plunger. The preload bushing holds the utility lock open with the balls retracted, and application of force to the plunger deforms the lip to release the plunger. A key for the lock comprises a finger member terminating in a plurality of individual fingers surrounding a spreader member having an enlarged end, and means for incrementally moving the spreader member to spread the fingers and thereafter moving the spreader member and fingers together. The spreader defines a central opening for matingly receiving the center post of the plunger face. In additional generations of the lock and key therefor, the center post and spreader member opening are both longer, wherein the keys for later generation locks open earlier generation locks and the keys for earlier generation locks will not open later generation locks. Permutations of the locks and keys are provided by altering the mating shapes of the center post and spreader member opening.

16 Claims, 14 Drawing Figures

Fig. 1.
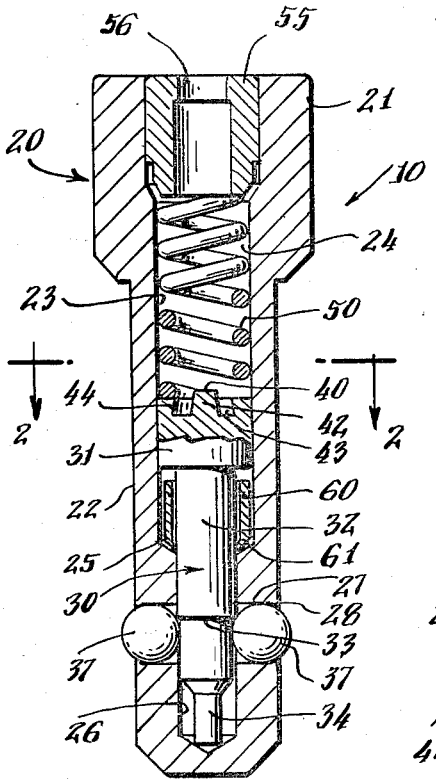
Fig. 2.
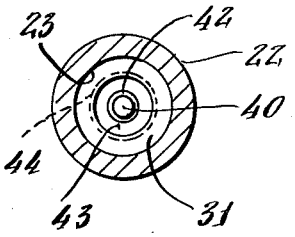
Fig. 3.
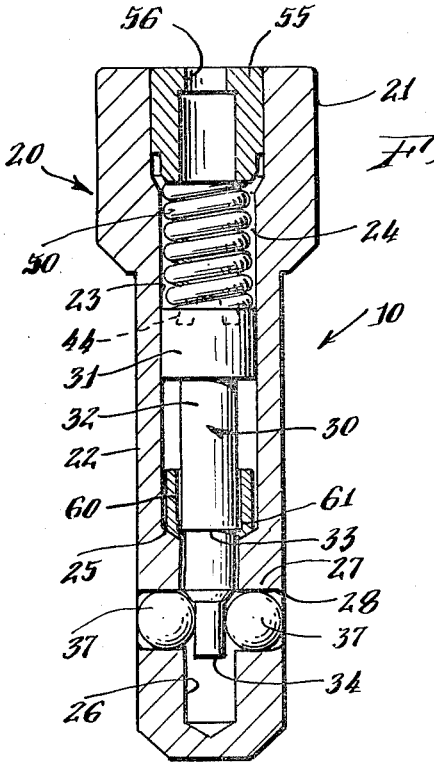
Fig. 4
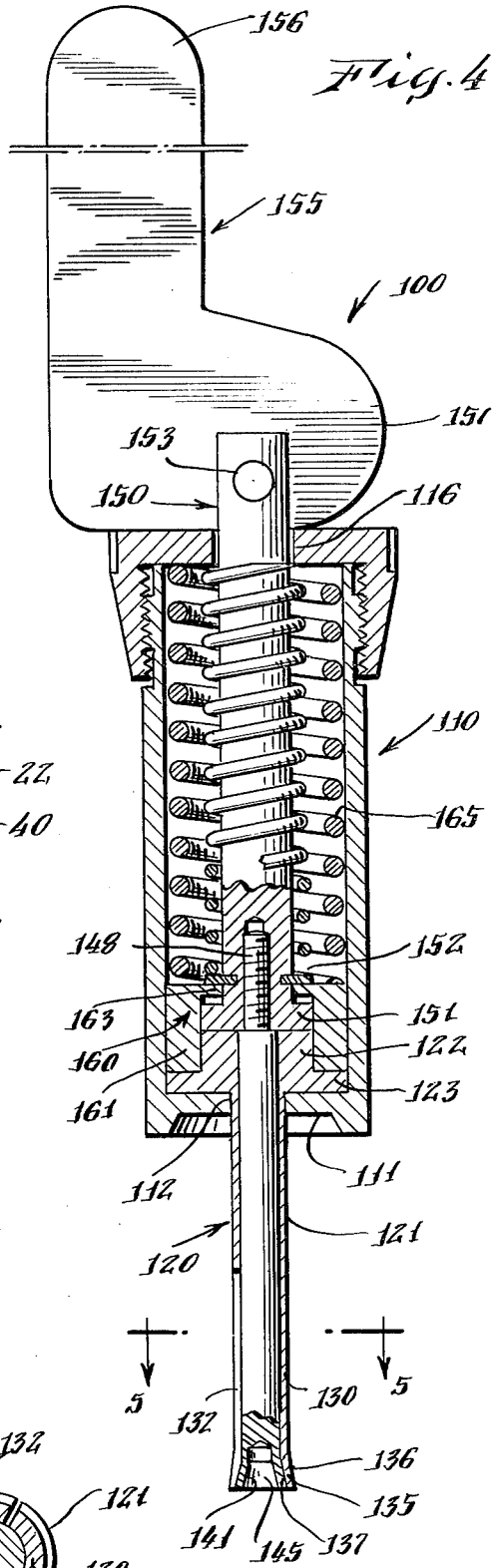
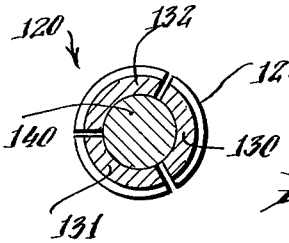
Fig. 5.

UTILITY LOCK AND KEY

BACKGROUND OF THE INVENTION

This invention relates to plunger-type utility locks which are highly pick resistant and which cannot be opened by existing keys, and to keys for the locks of this invention which also open many prior plunger-type locks.

Plunger-type utility locks, also sometimes referred to as barrel locks, are widely used by utility companies to prevent unauthorized access to meters, valves, connectors, etc. which control and measure the supply of utility services, such as electricity and gas. However, the locks are often defeated and the meters, valves, connectors, etc. tampered with to obtain utility services without charge. The problem is growing as the cost of utility services increases, because the higher costs result in a greater loss of revenue for each unit of service obtained without charge and the higher costs provide more incentive to obtain the services without charge.

In the most widely used plunger-type utility locks, the plunger has an axial opening of substantial length which receives a key adapted to open the lock. The plunger is spring biased away from the head of the lock and displaces locking balls radially outwardly beyond the shank of the lock to provide a locked condition. The typical key has fingers which are expanded to grip the plunger on the interior surface of its axial opening, and means for retracting the finger-gripped plunger to open the lock. Favored means of picking plunger-type locks include using a bent wire to hook the spring and pull it back to relieve the tension on the plunger, which can then fall to its open position, and jamming one or more nails or the like in the axial plunger opening and thereafter using the nail to retract the plunger and open the lock. A successful utility lock must resist these common means of picking.

However, the utility locks are not always opened by picking or other forceful means. Instead, they are often opened by or through the use of keys which have been lost by or stolen from the utility companies. Accordingly, any new utility lock will preferably resist being opened by existing keys. It will be understood that a utility company will not replace all of its locks at one time for reasons of economics, and it is desirable that the key for any new utility lock be capable of opening existing prior locks so that personnel will not have to carry more than one key. Utility companies also prefer to have a lock and key system which is not shared with other neighbor companies, so that a key lost by one utility company cannot be used to open locks of another utility company.

The distribution of keys can be further limited if the locks are designed to be supplied in their open condition and closed to their locked position without the use of the usual key. Thus, personnel merely installing locks do not need to be provided with a key.

It is also important that any new utility lock conform to the size and shape which has become standard throughout the various utility companies, so that receptacles for the locks and other equipment utilizing the locks to secure meters, valves, connectors, etc. can accept the new locks without alteration.

SUMMARY OF THE INVENTION

Accordingly, it is a principal object of the invention herein to provide a utility lock which is highly pick resistant.

It is another object of the invention herein to provide a utility lock which resists being opened by keys for prior utility locks.

It is an additional object of the invention herein to provide a key for the utility locks.

It is another object of the invention herein to provide a utility lock and key combination which can be provided in many permutations with several generations of each permutation, so that a different permutation can be provided to each of several utility companies and each company can have a successive series of new locks and keys with the new key opening old locks but old keys not opening new locks.

It is a further object of the invention to provide a utility lock of the above characteristics which is sized and shaped as standard plunger-type locks.

A utility lock according to the invention herein is sized and shaped like prior art plunger-type locks, and includes a shank having an enlarged head at one end thereof and balls which protrude radially outwardly from openings in the shank when the utility lock is in its locked condition. A plunger is axially slidably mounted in the shank and displaces the balls outwardly when it is down and permits the balls to retract when it is up. The plunger is biased downwardly away from the head of the utility lock by a coil spring. According to one feature of the invention, the coil spring must be fully compressed, i.e. with its coils touching one another, by the plunger before the plunger permits the balls to retract into the shank. If hooking means are inserted between the coils of the spring in order to pull it upwardly, the spring cannot be fully compressed and the lock will not open. Accordingly, the utility lock according to the invention herein resists picking of this type.

The top of the plunger defines a shallow annular groove surrounding a center post, and the center post may have varying heights and shapes to cooperate with a key for the lock, as more fully discussed below. Because the annular groove is very shallow, the top surface of the plunger presents an almost smooth surface to the would be lock picker. Thus, the utility lock resists picking by being jammed with nails or the like and resists other picking techniques which encompass gripping the plunger in order to pull it back. Thus, the utility lock according to the invention herein is highly pick resistant.

The key for the utility lock according to the invention herein includes a finger member terminating in a plurality of (preferably three) elongated fingers. The finger member and its fingers surround a spreader member, which has an enlarged end for spreading the fingers. The fingers and spreader extend from a handle, which is provided with a cam lever for incrementally moving the spreader member to spread the fingers and then moving the fingers and spreader upwardly together.

On the bottom surface of the spreader is an opening which mates with the center post of the plunger. Thus, when the key is inserted in the lock, the post is received in the opening in the spreader member, permitting the fingers to enter the annular groove of the plunger. Operating the cam lever of the key causes the spreader member to spread the fingers, which are forced against the inwardly facing surface of the annular groove to securely grip the plunger. This is aided by a bevel on the annular groove and a mating bevel on the finger members. The plunger is pulled up by the cam lever until the plunger has completely collapsed its biasing coil spring, permitting the balls to retract into the lock shank, thus opening the utility lock.

The center post of the plunger keeps prior keys out of the annular groove, and prior keys will not open the utility lock according to the invention herein. It will be appreciated that if the center post of the plunger is made somewhat longer, it would prevent the key from opening the utility lock unless the opening in the bottom surface of the spreader member were correspondingly lengthened. However, a key with a lengthened opening in the spreader member will open a utility lock with a short center post. This provides the basis for many generations of locks with successively longer center posts and corresponding keys, wherein the newest key will unlock the oldest lock but the older keys will not unlock the newer locks.

It will also be appreciated that the center post can have various shapes, such as round, square, triangular, etc., and the opening in the bottom surface of the spreader member can be correspondingly shaped, and this provides the basis for many permutations of locks. Thus, different utility companies can each be provided with a unique utility lock through the use of differently shaped center posts, and each of the utility companies has the opportunity for additional generations of utility locks by extending its unique center post.

The utility lock according to the invention herein is provided preloaded to its open condition. In this regard, a bushing surrounds the plunger within the shank of the lock, and the bushing has a small inwardly turned lip which is engaged with a small annular shoulder on the plunger, provided by a slight step-down in the diameter of the plunger. The engagement between the bushing and the plunger holds the lock in its open position. Once the utility lock is installed in the desired position, any blunt rod may be inserted through the head to engage the plunger, and a moderate blow to the plunger deforms the lip of the bushing and permits the lock to close. Thereafter, the bushing slides with the plunger within the shank and does not interfere with the operation of the utility lock. This means of preloading the utility lock is positive, and sufficiently strong that the utility lock does not accidentally close on being dropped. The deformation of the lip also does not result in any loose pieces being set free in the utility lock, which might jam its smooth operation.

Other and more specific objects and features of the invention herein will in part be obvious and will in part appear from a perusal of the following description of the preferred embodiments and the claims together with the drawings.

DRAWINGS

FIG. 1 is a longitudinal sectional view of a plunger-type utility lock according to the invention herein in its locked position;

FIG. 2 is a sectional view of the utility lock of FIG. 1 taken along the lines 2—2 of FIG. 1, showing the plunger face;

FIG. 3 is a longitudinal sectional view of the utility lock of FIG. 1 preloaded in its open condition;

FIG. 4 is a longitudinal sectional view of a key according to the invention herein for the utility lock of FIG. 1;

FIG. 5 is a sectional view of the key of FIG. 4 taken along the lines 5—5 of FIG. 4;

The same reference numerals refer to the same elements throughout the various Figures.

DESCRIPTION OF PREFERRED EMBODIMENTS

Figure 6:
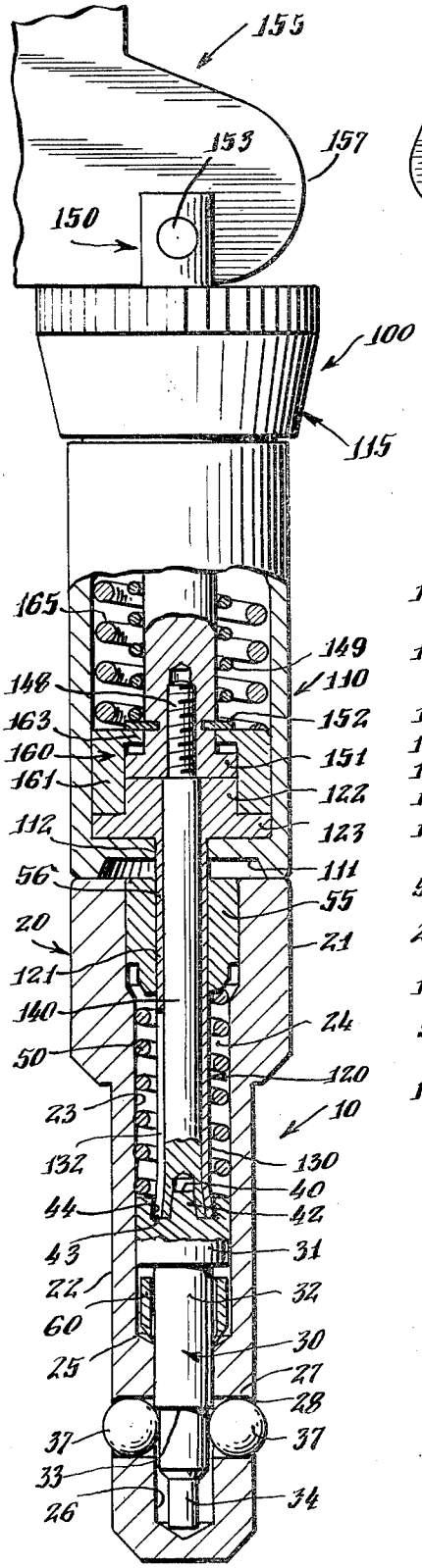
FIG. 6 is a side elevation view, partially in section, of the key of FIG. 4 inserted in the utility lock of FIG. 1.

A utility lock 10 according to the invention herein is shown in FIGS. 1–3. The utility lock 10 generally comprises a lock body 20, a plunger 30 and a spring 50 biasing the plunger 30 downwardly in the lock body to extend two radially protruding locking balls 37. A plug 55 supports the upper end of the spring 50, and defines a central opening 56 providing access to the plunger face 40 of the plunger 30. A preload bushing 60 is provided to hold the utility lock 10 in its open condition upon manufacture, shipment and initial installation, all as will be more fully discussed below.

The lock body 20 comprises a cylindrical head 21 and a cylindrical shank 22 of smaller diameter. The lock body 20 defines an axial plunger-receiving opening 23 which includes a larger diameter upper portion 24, a shoulder 25 and a smaller diameter lower portion 26. Two ball-accommodating openings 27 extend through the shank 22 from the lower portion 26 of the plunger-receiving opening 23, and and the ball-accommodating openings 27 are provided with lips 28 to retain balls 37 therein.

The directions "lower" or "downward" as referred to herein shall mean away from the head 21 of the utility lock 10, as shown in the various Figures, although the utility lock 10 can be used in any orientation.

The plunger 30 is slidably mounted in the plunger-receiving opening 23 of the lock body 20, and the plunger 30 includes a head 31 and an integral depending locking shaft 32. The locking shaft 32 has a diameter, generally such that it is received in the smaller diameter lower portion 26 of the plunger-receiving opening 23, but is provided with a small shoulder 33 approximately midway along its length which does not interfere with up and down sliding motion of the plunger. The plunger further includes a release shaft 34 depending from the locking shaft 32, the release shaft being of smaller diameter than the locking shaft.

The two locking balls 37 are mounted in the ball-accommodating openings 27. With reference to FIG. 1, when the plunger 30 is in its lowermost position, its locking shaft 32 is positioned adjacent the locking balls 37 and displaces the locking balls 37 radially outwardly from the shank 22 of the lock body 20. When the plunger 30 is in its upper position, as illustrated in FIG. 3, its release shaft 34 is positioned adjacent the locking balls 37. Because it is of smaller diameter, the release shaft 34 permits the locking balls 37 to retract within the shank 22 of the lock body 20, wherein the utility lock is "unlocked".

Coil spring 50 extends between the top surface or "face" 40 of plunger 30 and a plug 56 secured in the head 21 of the lock body 20. It will be appreciated that the coil spring 50 biases the plunger 30 downwardly to maintain the utility lock 10 in its locked position, shown in FIG. 1. The plug 55 defines a central opening 56 providing access for the key which is used to unlock the utility lock 10.

The foregoing description of the utility lock 10 covers its structural aspects which are generally in common with prior art utility locks. The outside shape and dimensions of the utility lock 10 also conform with what has become standard for utility companies, so that the utility lock 10 can be used with other existing equipment. However, two unique features of the utility lock 10 according to the invention herein are illustrated in FIG. 3.

First, it will be noted that the utility lock 10 is in its open position, i.e. the plunger 30 is up and the balls 37 are retracted into the shank 22 of the lock body 20, and that this is achieved without the presence of a key. This is known as the "preloaded" open position, and is achieved according to the invention herein by a preload bushing 60. The preload bushing 60 is generally tubular and surrounds the locking shaft 32 of the plunger 30. It is slidably received in the larger diameter upper portion 24 of the plunger-receiving opening 23 and rests against shoulder 25 between the upper portion 24 and lower portion 26 thereof. The preload bushing 60 is provided with an inturned lip 61 which engages the small shoulder 33 on the locking shaft 32 and thereby prevents the coil spring 50 from biasing the plunger 30 to its lower position shown in FIG. 1. It will be appreciated that the position of the shoulder 33 on the locking shaft 32 is chosen such that the preload bushing holds the plunger 30 in its unlocked position, i.e. with the release shaft 34 positioned adjacent the locking balls 37. The preload bushing 60 is preferably fabricated of bronze or other relatively soft metals. It is sufficiently strong to maintain the utility lock 10 in its open position despite shock loads that might be applied during the final manufacturing steps, shipping, and the like. Once the utility lock 10 has been placed in its desired installation, the installer may insert a blunt rod through the opening 56 in plug 50 so that the end of the rod bears on the upper surface of the plunger 30. A sharp blow transmitted to the plunger through the rod will deform the lip 61 from the preload bushing 60 permitting the plunger to pass so that the utility lock 10 may close. Thereafter, the preload bushing 60 rides with the plunger within the lock body 20, and there are no loose pieces to interfere with the normal operation of the utility lock 10.

As also illustrated in FIG. 3, the coil spring 50 is fully compressed when the plunger 30 is in its upper position, i.e. when the utility lock 10 is unlocked. More particularly, the adjacent coils of the coil spring 50 are touching. Thus, the utility lock 10 cannot be picked by inserting hook means between the coils of coil spring 50 and pulling the coil spring 50 upwardly to release the plunger 30, because any picking means positioned between the coils of the coil spring 50 prevent it from fully compressing to permit the plunger 30 to release the locking balls 37.

The plunger face 40 of the utility lock 10, cooperates with a key 100 for opening utility lock 10, as will be more fully discussed below. The plunger face 40 comprises a relatively short central post 42 which is surrounded by an annular groove 43. The outside surface 44 of the annular groove 43 is preferably provided with a reverse bevel, i.e. the diameter of the annular groove 43 is larger at the bottom than at the top. The reverse bevel is preferably on the order of approximately five degrees from the longitudinal axis of the plunger 30. The annular groove 43 is relatively shallow, on the order of 0.50–0.10 inch. More particularly, the annular groove 43 is not sufficiently deep to accept and retain jam-type picking tools, such as nails or the like. Thus, the plunger face 40 presents a relatively smooth surface to picking tools and resists their gripping the plunger 30 for attempted picking of the utility lock 10.

A key 100 according to the invention herein for the utility lock 10 is illustrated in FIGS. 4 and 5. The key 100 comprises a tubular body 110 having a bottom wall 111 defining a central opening 112 therethrough. The upper end of the body 110 is threaded, and a cap 115 is threaded to the top of body 110. The cap 115 also defines a central opening 116.

A finger member 120 is slidably mounted in the body 110, and the finger member 120 comprises a tubular shaft 121 extending through the central opening 112 in the bottom wall 111 of the body 110. The tubular shaft 121 has a collar 122 at its upper end and a flange 123 extends radially from the collar 122 to the wall of the body 110. The lower end of the tubular shaft 121 is separated by slots into three elongated fingers 130, 131 and 132. As best seen in FIG. 5, the fingers 130–132 are evenly spaced in a circular array. The terminal free end 135 of finger 130 is inclined radially outwardly, and in particular the outer surface 136 thereof is inclined radially outwardly at angle A which is approximately equal to the angle inclination of the surface 44 of the annular groove 43 in the plunger face 40. As noted above, this angle may be approximately five degrees. The inner surface 137 of the finger end 135 is also inclined radially outwardly by an angle B which may be approximately fifteen degrees. Angle B is illustrated on the end of the finger 132 in FIG. 4, and it will be understood that the ends of all the fingers 130–132 are similar.

Figure 10:
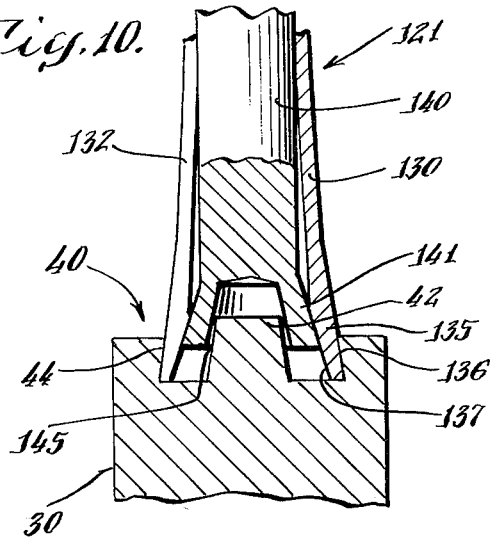
FIG. 10 is an enlarged segmental view of a portion of FIG. 7 showing the fingers of the key engaged with the plunger of the utility lock.

The finger member 120 surrounds a spreader 140. The spreader 140 has an enlarged end 141 the outer surface of which is inclined radially outwardly to match the inner surface 136 of the finger 130, as well as the inner surfaces of the other fingers 131 and 132. The bottom of the spreader 140 is provided with a central opening 145 which is matingly configured with the center post 42 of the plunger face 40. It will be appreciated that when the spreader 140 is displaced upwardly with respect to the finger member 120, the enlarged end 141 of the spreader will spread the fingers 130–132, as illustrated in FIGS. 7 and 10.

The upper end of the spreader 140 is secured to a rod 150 by means of a threaded stud 148, and the rod 150 extends upwardly through the key body 110 and the central opening 116 in the cap 115. The upper end of the rod 150 is longitudinally slotted to receive a lever 155, which is pivotally secured to the rod 150 via a pin 153. The lever 155 has a handle portion 156 and a cam surface 157, and when the lever 155 is rotated about pin 153, the cam surface 157 acts against the top of the cap 115 to drive the rod 150 upwardly. The lower end of the rod 150 is provided with a radially protruding flange 151, which is biased against the collar 122 of the finger member 120 by means of a rod coil spring 149 extending between the underside of the cap 115 and a clip 152 keyed to the rod 150. When the handle 156 of lever 155 is in its upward position, as illustrated in FIG. 4, the rod 150 and spreader 140 are biased downwardly with the bottom of flange 151 of the rod 150 bearing against the collar 122 of the finger member 120. The lower end of the spreader 140 is even with the ends of fingers 130–132.

The key 100 is further provided with a limiter 160 and a main coil spring 165. The limiter 160 includes a cylindrical sidewall 161 which slidably surrounds the collar 122 of the finger member 120 and also slidably surrounds the flange 151 of the rod 150. The lower surface of the sidewall 161 bears against the radially extending flange 123 of the finger member 120. The coil spring 165 is interposed between the limiter 160 and the underside of the cap 115, and biases the limiter 160 and the finger member 120 downwardly. The limiter 160 further includes a radially inwardly extending flange 163, which is disposed above the flange 151 of rod 150 by a distance D.

Figure 7:
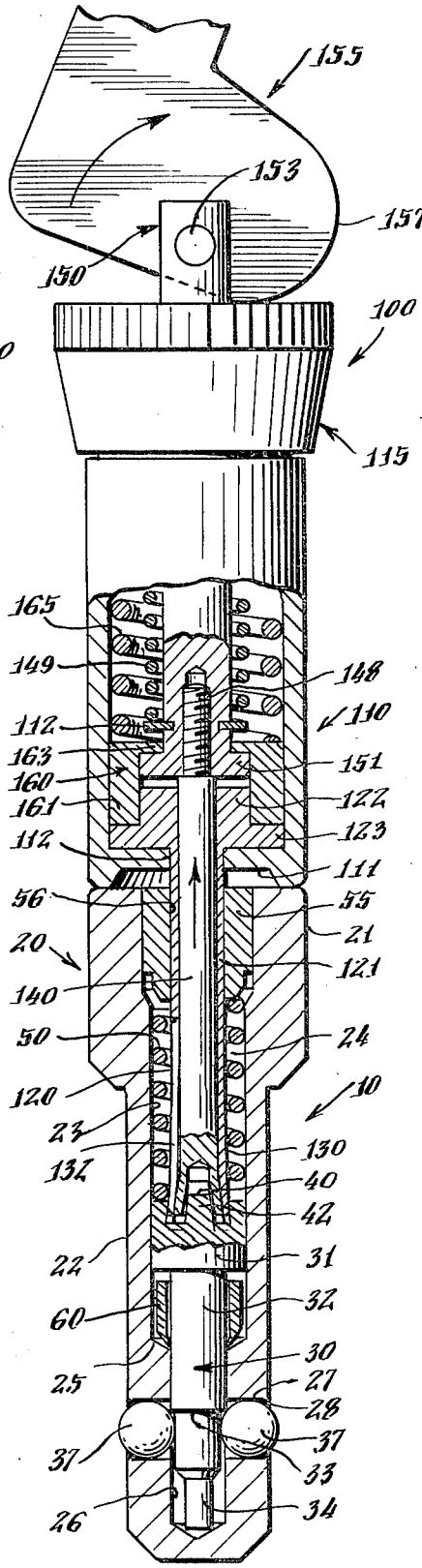
FIG. 7 is a side elevation view, partially in section, of the key of FIG. 4 inserted in the utility lock of FIG. 1 with the key manipulated to engage the plunger of the utility lock.
Figure 8:
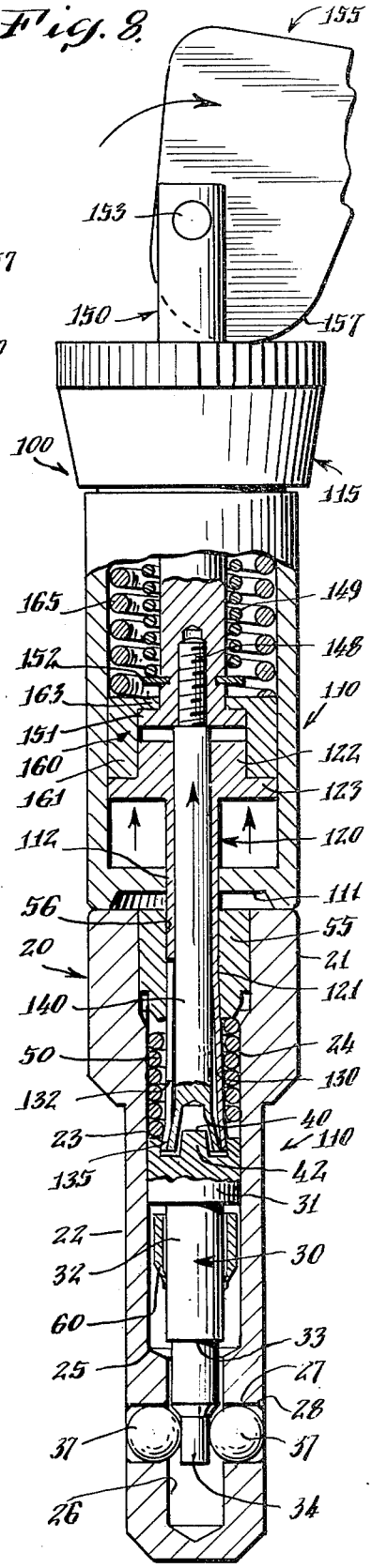
FIG. 8 is a side elevation view, partially in section, of the key of FIG. 4 inserted in the utility lock of FIG. 1 with the key manipulated to unlock the utility lock.
Figure 9:
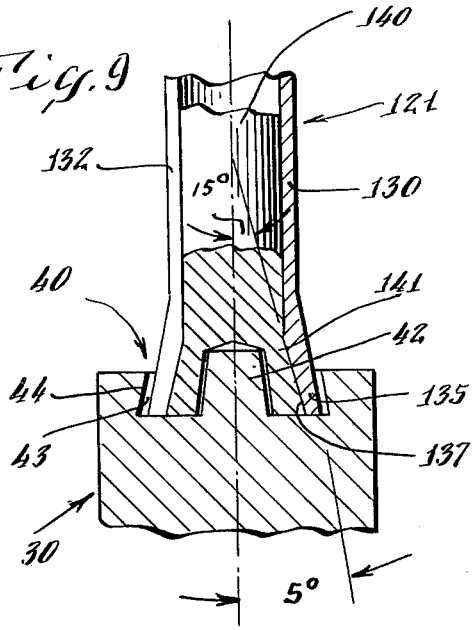
FIG. 9 is an enlarged segmental view of a portion of FIG. 6 showing the spreader member and fingers of the key received on the plunger of the utility lock.

The operation of the key 100 will be explained with reference to FIGS. 6–8, showing the key 100 being utilized to open the utility lock 10. Referring first to FIG. 6, the protruding finger member 120 and spreader 140 of the key 100 are inserted through the opening 56 defined by the plug 55 in the head 21 of the lock body 20. The bottom 111 of the key body 100 rests against the top of the lock body 20. The post 42 of the plunger face 40 is matingly received in the opening 145 defined in the bottom of the spreader 140 and the fingers 130–132 of the finger member 120 together with the bottom of the spreader member 140 are received in the annular groove 43 of the plunger face 40. The reception of the lower end of key 100 on the plunger face 40 is also illustrated in FIG. 9.

Referring now to FIG. 7, the lever 155 of the key 100 is rotated to incrementally lift the rod 150, and in particular, the flange 151 on the lower end of the rod 150 is pulled upwardly by the distance D into engagement with the flange 163 of the limiter 160. The main coil spring 165 maintains the limiter 160 and the finger member 120 urged against the bottom wall 111 of the key body 110. Thus, the spreader 140 is drawn upwardly with respect to the finger member 120, and the enlarged end 141 of the spreader 140 spreads the fingers 130–132 into engagement with the outside surface 44 of the annular groove 43 in the plunger face 40. A detailed view of the engagement is provided in FIG. 10, and in particular shows the close contact achieved between the reverse beveled surface 44 of annular groove 43 and the correspondingly angled outer surface 136 of the end 135 of finger 130. The plunger 30 of the utility lock 10 has not been raised in FIG. 7, and the locking shaft 32 of the plunger 30 maintains the locking balls 37 displaced radially outwardly from the shank 22 of the lock body 20.

Referring now to FIG. 8, as the lever 155 is fully rotated, the cam surface 157 thereof operates to raise the rod 150 its maximum extent, compressing springs 149 and 165 in the process. The flange 151 of the rod 150 is engaged against the flange 163 of the limiter 160, and hence the limiter 160 is raised with the rod 150. The spreader 140 follows, being secured to the rod 150. Because the finger member 120 is wedged between the spreader 140 and the plunger 30, both the finger member 120 and plunger 30 are pulled upwardly, thereby compressing the spring 50 in the utility lock 10. The release shaft 34 of the plunger 30 is thus positioned adjacent the locking balls 37, permitting the locking balls 37 to retract within the shank 22. The utility lock 10 is thus unlocked by operation of the key 100. The key 100 may be released from the utility lock 10, and the utility lock 10 again locked, by rotating the lever 155 to the position shown in FIG. 6.

Figure 11:
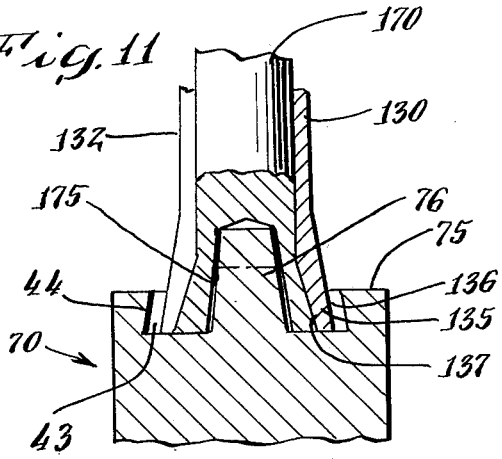
FIG. 11 is an enlarged sectional view of a modified plunger for the utility lock of FIG. 1 and a correspondingly modified key, according to the invention herein.

Referring now to FIG. 11, a modified plunger 70 for the utility lock 10 according to the invention herewith is illustrated together with a modified spreader 170 for key 100. The modified plunger 70 has plunger face 75 characterized by a central post 76 of greater length than the center post 42 of plunger face 40 of the plunger 30. The modified spreader 170 defines a central opening 175 matingly accommodating the longer post 76 of the plunger 70; hence opening 175 of modified spreader 170 has a depth greater than opening 145 of spreader 140.

Figure 12:
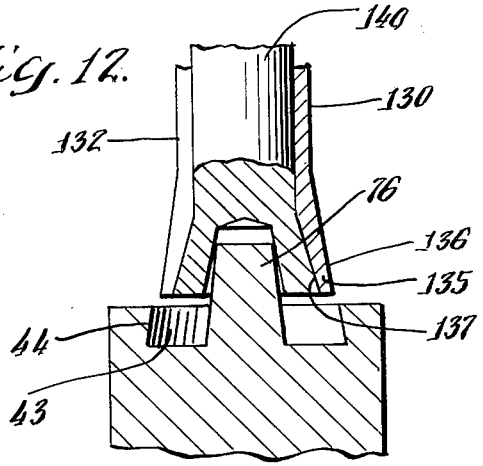
FIG. 12 is an enlarged sectional view of the key of FIG. 4 not being received by the modified plunger of FIG. 11.

With reference to FIG. 12, it can be seen that the key 100 including spreader 140 will not open the utility lock 10 with the modified plunger 70, because the enlarged center post 76 is not accommodated in the opening 145 defined in the bottom of the spreader 140. This prevents the engagement of the fingers 130–132 in the annular groove 43. However, the key 100 with the modified spreader 170 will open the utility lock 10 with plunger 30, inasmuch as the opening 175 in the bottom of the spreader 170 easily accommodates the central post 42 of the plunger face 40. Thus, the utility lock 10 incorporating the modified plunger 70 can be considered as a "second generation" utility lock together with the key 100 having the modified spreader 170. If security breaks down with respect to utility lock 10 with plunger 30 and key 100 with spreader 140, such as by loss of one or more of the keys, a utility company can begin to install the utility lock 10 with modified plunger 70 and provide its employees with keys having modified spreader 170. The employees will thus be able to open all utility locks 10, whether with plungers 30 or 70, but the wrongful possessors of the key 100 with spreader 140 will not be able to open the utility lock 10 with the modified plunger 70. Further generations of utility locks and keys can be provided by merely lengthening the center post of the plunger face in discreet intervals, and increasing the depth of the opening in the spreader accordingly.

Figure 13:
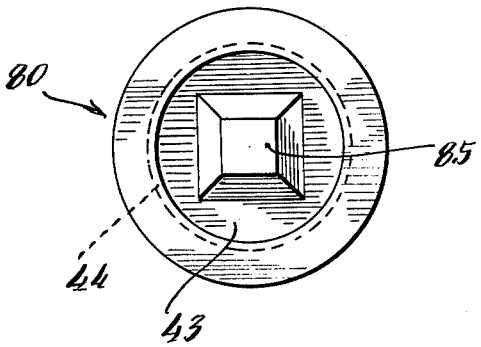
FIG. 13 is an end view of another modified plunger for the utility lock of FIG. 1, according to the invention herein.

FIG. 13 illustrates a modified plunger 80 for utility lock 10, according to the invention herein. The face of the modified plunger 80 includes a central post 85 having a square cross section. It will be appreciated that a modified spreader for key 100 will define a central opening of square cross section for matingly accommodating the square central post 85. The modified plunger 80 and the key therefor constitute a "permutation" of the above-described utility lock 10 with plungers 30 or 70 and corresponding key 100. In particular, the key 100 with spreaders 140 or 170 will not open the utility lock 80, because the square cross section center post 85 is not receivable in the central opening in the bottom of the plungers 30 or 70. It will further be appreciated that the square center post 85 can be lengthened to provide additional generations of the permutation of the utility lock 10 illustrated in FIG. 13.

Figure 14:
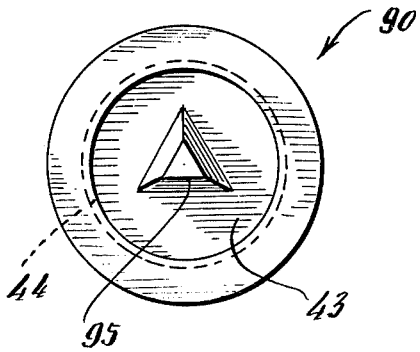
FIG. 14 is an end view of another modified plunger for the utility lock of FIG. 1, according to the invention herein.

An additional permutation of utility lock 10 is illustrated in FIG. 14, and more particularly, a modified plunger 90 is characterized by a triagular central post 95. Keys for other permutations will not open this permutation, nor will the key for this permutation open other permutations of utility locks. Additional generations of the utility lock 10 with plunger 90 can be provided by lengthening the triangular central post and modifying the spreader of the key therefor.

Accordingly, the foregoing utility locks admirably achieve the objects of the invention herein. They are highly pick resistant, and provide for additional generations which cannot be opened by keys of prior generations. They also provide for many permutations, wherein many utility companies can have unique locks and keys. It will be appreciated that shapes of the central post other than those described above can be employed to expand the number of permutations available. It will also be appreciated that various changes from the specific structure of the preferred embodiments described above can be made without departing from the spirit and scope of the invention, which is limited only by the following claims.

I claim:

1. An improvement in a utility lock of the type comprising a lock body having a head and shank, a plunger axially slidably received in the lock body, expansible locking balls which are alternatively held extending radially outwardly from the shank by the plunger and retracted within the shank adjacent a smaller diameter portion of the plunger depending upon the position of the plunger and a coil spring biasing the plunger to position the locking balls disposed radially outwardly, the head of the lock body defining an axial opening for admitting a key of the type having fingers expansible by a spreader member, the improvement comprising the plunger having a plunger face to which the fingers and spreaders member of the key are presented, the plunger face having a generally axially disposed annular surface with a short axial dimension, the annular surface being gripped by the expanded fingers of the key to lift the plunger against the biasing spring and thereby open the utility lock, wherein the plunger face is substantially flat with respect to jam type picking tools and resists accepting and retaining jam type picking tools.

2. A utility lock as defined in claim 1 wherein the axial dimension of the generally axially disposed annular surface of the plunger face is between 0.05 and 0.10 inch.

3. A utility lock as defined in claim 1 wherein the generally axially disposed annular surface of the plunger face is reverse beveled, having its smallest diameter adjacent the top surface of th plunger head.

4. A utility lock as defined in claim 3 wherein the reverse bevel is at an angle of approximately 5 degrees.

5. A utility lock as defined in claim 1 wherein the plunger face further comprises an upstanding axially disposed center post wherein an annular groove is defined between the center post and the generally axially disposed annular surface.

6. A utility lock as defined in claim 1 wherein the coil spring is fully compressed with its coils touching when the plunger is positioned with the release shaft adjacent the ball-accommodating openings to permit the locking balls to retract in the lock body, wherein the presence of picking tools between the coils prevents the coil spring from fully compressing and thereby prevents the utility lock from opening.

7. A utility lock as defined in claim 1 wherein the plunger includes a locking shaft extending from an enlarged head of the plunger and the locking shaft defines a shoulder and the lock body receives the plunger in a plunger-receiving opening having a larger diameter portion extending from the head of the lock body to a shoulder and a smaller diameter portion extending from the shoulder toward the end of the shank, the utility lock further comprising:

F. a preload bushing surrounding the locking shaft between the shoulder of the plunger-receiving opening and the head of the plunger, the preload bushing including an inturned lip engaging the shoulder of the locking shaft, the preload bushing resting on the shoulder of the plunger-receiving opening to hold the plunger with the release shaft positioned adjacent the ball-accommodating openings to permit the locking balls to be retracted within the shank, the lip of the locking bushing being deformable upon application of force to the plunger face, thereby releasing the plunger so that the coil spring biases the plunger to engage the locking shaft with the locking balls.

8. A utility lock as defined in claim 7 wherein the coil spring is fully compressed with its coils touching when the plunger is positioned with the release shaft adjacent the ball-accommodating openings to permit the locking balls to retract in the lock body, wherein the presence of picking tools between the coils prevents the coil spring from fully compressing and thereby prevents the utility lock from opening.

9. A utility lock as defined in claim 5 and further comprising:

(F) a key for the utility lock, the key having;

(1) a key body, (2) a finger member extending from the key body and terminating in a plurality of individual fingers, (3) a spreader member surrounded by the finger member, the spreader member including an enlarged end for spreading the fingers upon relative movement between the spreader member and finger member, the spreader member having a bottom surface defining an opening for matingly receiving the center post of the plunger with the fingers positioned adjacent the annular generally axially disposed surface, (4) means for incrementally moving the spreader member toward the key body to spread the fingers and thereafter moving the fingers and spreaders together toward the key body, wherein when the spreader member is positioned to matingly receive the center post of the plunger face, operating the moving means first engages the fingers with the generally axially disposed annular surface of the plunger face and thereafter lifts the plunger against the coil spring to position the release shaft of the plunger adjacent the ball-accommodating openings, permitting the locking balls to retract within the shank.

10. A utility lock and key as defined in claim 9 wherein the generally axially disposed annular surface of the plunger face is reverse beveled having its smallest diameter adjacent the top surface of the plunger and the ends of the individual fingers of the finger member for engaging the reverse beveled surface of the plunger face are matingly reverse beveled.

11. A utility lock and key as defined in claim 9 and further comprising additional generations of the utility lock and key defined by claim 9, the additional generations of utility locks having successively incrementally longer center posts and the additional generations of keys having correspondingly incrementally deeper openings for receiving the incrementally longer center posts, whereby keys of the later generations will open utility locks of earlier generations having shorter center posts but earlier generation keys having shorter central openings will not open later generation utility locks having longer center posts.

12. A utility lock and key as defined in claim 9 wherein the center post of the plunger face has a round sectional configuration and wherein the spreader member of the key defines an opening having a generally round sectional configuration for matingly receiving the center post of the plunger face.

13. A utility lock and key as defined in claim 12 and further comprising additional generations of the utility lock and key defined by claim 12, the additional generations of utility locks having successively incrementally longer center posts and the additional generations of keys having correspondingly incrementally deeper openings for receiving the incrementally longer center posts, whereby keys of the later generations will open utility locks of earlier generations having shorter center posts but earlier generation keys having shorter central opening will not open later generation utility locks having longer center posts.

14. A utility lock and key as defined in claim 9 wherein the center post of the plunger face has a polygonal sectional configuration and the spreader member of the key defines an opening having a matingly polygonal shape for matingly receiving the center post of the plunger face.

15. A utility lock and key as defined in claim 14 and further comprising additional generations of the utility lock and key defined by claim 14, the additional generations of utility locks having successively incrementally longer center posts and the additional generations of keys having correspondingly incrementally deeper openings for receiving the incrementally longer center posts, whereby keys of the later generations will open utility locks of earlier generations having shorter center posts but earlier generation keys having shorter central openings will not open later generation utility locks having longer center posts.

16. An improvement in a utility lock of the type comprising a lock body having a head and shank, a plunger slidably received in the lock body, expansible locking balls which are alternatively held extending radially outwardly from the shank by the plunger and retracted within the shank adjacent a smaller diameter portion of the plunger depending upon the position of the plunger and a coil spring biasing the plunger to position the locking balls disposed radially outwardly, the improvement comprising a preload bushing having a deformable lip engaging a shoulder of the plunger for holding the plunger in the position permitting the balls to retract within the locking shank, the lip of the bushing being deformable to release the shank upon application of force thereto.

* * * * *